US006347791B1

(12) United States Patent
Chervenak

(10) Patent No.: US 6,347,791 B1
(45) Date of Patent: Feb. 19, 2002

(54) FULL FACE PAD

(75) Inventor: Thomas Michael Chervenak, Beatrice, NE (US)

(73) Assignee: American Tool Companies, Inc., Hoffman Estates, IL (US)

( * ) Notice: Subject to any disclaimer, the term of this patent is extended or adjusted under 35 U.S.C. 154(b) by 0 days.

(21) Appl. No.: 09/495,730

(22) Filed: Feb. 1, 2000

(51) Int. Cl.[7] ..... B25B 1/00
(52) U.S. Cl. ..... 269/6; 269/283; 269/166
(58) Field of Search ..... 269/6, 147, 148, 269/149, 150, 166, 283, 284, 279, 274; 81/487

(56) References Cited

U.S. PATENT DOCUMENTS

| | | | | |
|---|---|---|---|---|
| 2,258,686 | A | | 10/1941 | Olney |
| 2,340,316 | A | | 2/1944 | Fest |
| 2,519,107 | A | | 8/1950 | Brown |
| 2,766,649 | A | | 10/1956 | Labry, Jr. |
| 2,778,257 | A | | 1/1957 | Linskey et al. |
| 2,796,787 | A | | 6/1957 | Aske |
| 4,252,305 | A | | 2/1981 | Pasch |
| D274,034 | S | | 5/1984 | Lacina |
| 4,905,550 | A | | 3/1990 | Albrecht |
| 5,143,359 | A | | 9/1992 | Bush |
| D331,180 | S | | 11/1992 | Sorenson |
| 5,243,883 | A | | 9/1993 | Savage |
| D340,851 | S | | 11/1993 | Sorensen |
| D341,069 | S | | 11/1993 | Sorensen |
| D366,819 | S | | 2/1996 | Wooster, Jr. et al. |
| D366,820 | S | | 2/1996 | Wooster, Jr. et al. |
| 5,988,616 | A | | 11/1999 | Fuller et al. |
| 6,029,964 | A | * | 2/2000 | Bohl ..... 269/283 |
| 6,039,313 | A | * | 3/2000 | Baculy ..... 269/283 |

FOREIGN PATENT DOCUMENTS

DE 296 16 425 6/1997

OTHER PUBLICATIONS

American Tool Catalog, published by American Tool Companies, Inc., pp. 10–11 and 13. It is believed that the catalog was published before Jun. 26, 1997.

Paper showing seven photographs of a clamping pad with a side opening and a ridge near the opening. The pad shown in the paper is believed to have been first available to the public in 1991.

Pending American Tool Companies, Inc. Patent Application No.: 09/433,040, Inventor: Fuller et al., Filing Date: Oct. 25, 1999.

* cited by examiner

*Primary Examiner*—Robert C. Watson
(74) *Attorney, Agent, or Firm*—Brinks Hofer Gilson & Lione

(57) ABSTRACT

A full face clamp pad having an engagement surface, a first wall attached to and extending away from the engagement surface, a second wall attached to and extending away from the engagement surface, a third wall attached to and extending away from the engagement surface and a flange attached solely to the first wall and extending above the engagement surface.

36 Claims, 5 Drawing Sheets

FULL FACE PAD

BACKGROUND OF THE INVENTION

1. Field of the Invention

This invention relates to a full face pad for attachment to a clamping jaw.

2. Discussion of Related Art

Bar clamps and C-clamps typically employ a fixed jaw and a movable jaw that is movable toward the fixed jaw. When an object is placed between the fixed and movable jaws, the movable jaw is moved toward the fixed jaw until both jaws contact the object. There is often a concern that the pressing of the jaws against the object will damage the object. In order to alleviate this concern, plastic pads have been placed on the jaws. Examples of such plastic pads are the full face pads manufactured by American Tool Companies, Inc. which are used with the bar clamps manufactured by Petersen Manufacturing Co., Inc. made under the QUICK-GRIP® trademark. Other examples of full face pads are disclosed in U.S. Design Pat. Nos. D 341,069 and D 340,851 and U.S. Pat. No. 5,988,616, the entire contents of each of which is incorporated herein by reference.

SUMMARY OF THE INVENTION

One aspect of the present invention regards a full face clamp pad that has an engagement surface, a first wall attached to and extending away from the engagement surface, a second wall attached to and extending away from the engagement surface, a third wall attached to and extending away from the engagement surface and a flange attached solely to the first wall and extending above the engagement surface.

A second aspect of the present invention regards a full face clamp pad that has an engagement surface and a receiving element attached to the engagement surface, wherein the receiving element has a movable flange with unattached sides and the receiving element defines a closed opening that faces the engagement surface.

A third aspect of the present invention regards a method of attaching a clamp pad with an opening and a movable flange to a clamping face of a clamping jaw. The method includes placing a clamping face of a clamping jaw above an opening of a clamp pad and pushing the clamping face inward toward a rear side of the clamp pad so that a portion of the clamping face engages the flange at a first position and moves the flange toward the rear side of the clamp pad. The clamp face is continued to be pushed inward toward the rear side of the clamp pad so that the clamping face ceases to contact the flange and the flange is returned to the first position.

Each aspect of the above-mentioned invention presents the advantage of improved securement of a full face clamp pad to a clamping jaw.

DESCRIPTION OF THE PREFERRED EMBODIMENT

Figure 2:
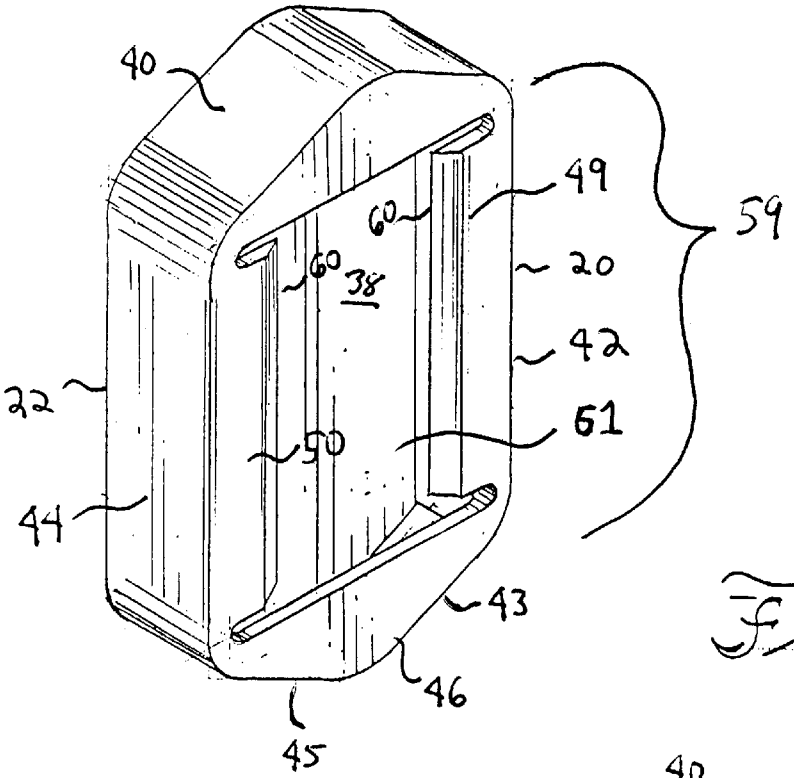
FIG. 2 is a rear perspective view of the full face pad used with the bar clamp of FIG. 1.
Figure 4:
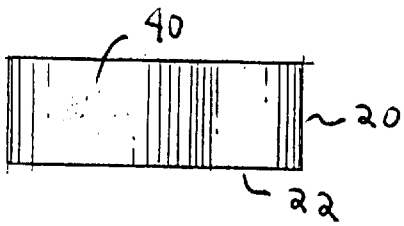
FIG. 4 is a top view of the full face pad of FIG. 2.
Figure 3:
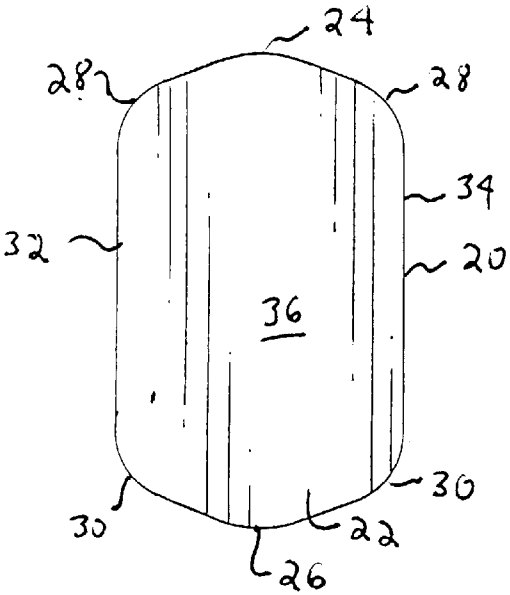
FIG. 3 is a front view of the full face pad of FIG. 2.
Figure 7:
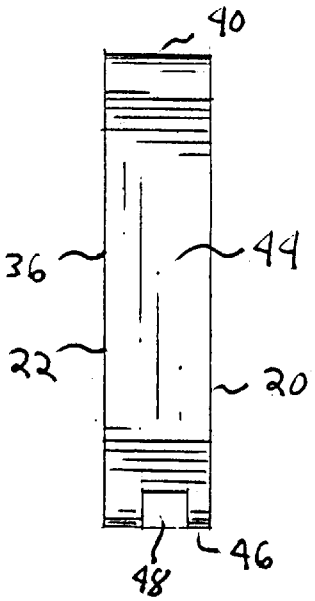
FIG. 7 is a left side view of the full face pad of FIG. 2.

A full face clamp pad 20 according to the present invention is shown in FIGS. 1–9. As shown in FIGS. 1–9, the full face clamp pad 20 has a six sided engagement surface 22 that has a maximum length of approximately 2 7/16" as measured from corners 24 and 26 and a minimum length of approximately 2 3/8" as measured from corners 28 and 30. Each of the front side edges 32 and 34 has a length of approximately 1½" and are parallel to and separated from one another by approximately 1½". Top corner 24 and bottom corner 26 are aligned with each other along a line parallel to the side edges 32 and 34. Furthermore, top corner 24 rises above corners 28 by an amount that is equal to the amount that bottom corner is below corners 30 which is approximately 3/8". The front side 36 of the engagement surface 22 is shown in FIG. 3 and is designed to firmly clamp a workpiece.

Figure 8:
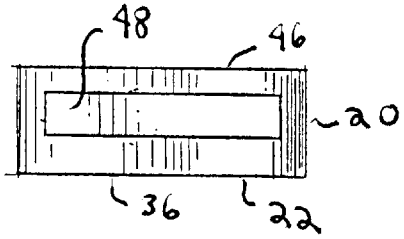
FIG. 8 is a bottom view of the full face pad of FIG. 2.
Figure 5:
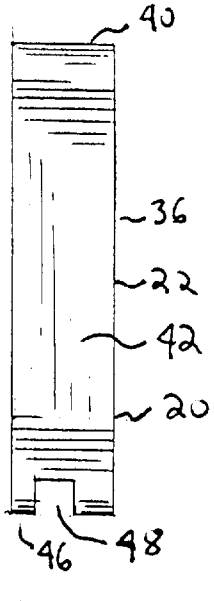
FIG. 5 a right side view of the full face pad of FIG. 2.
Figure 11:
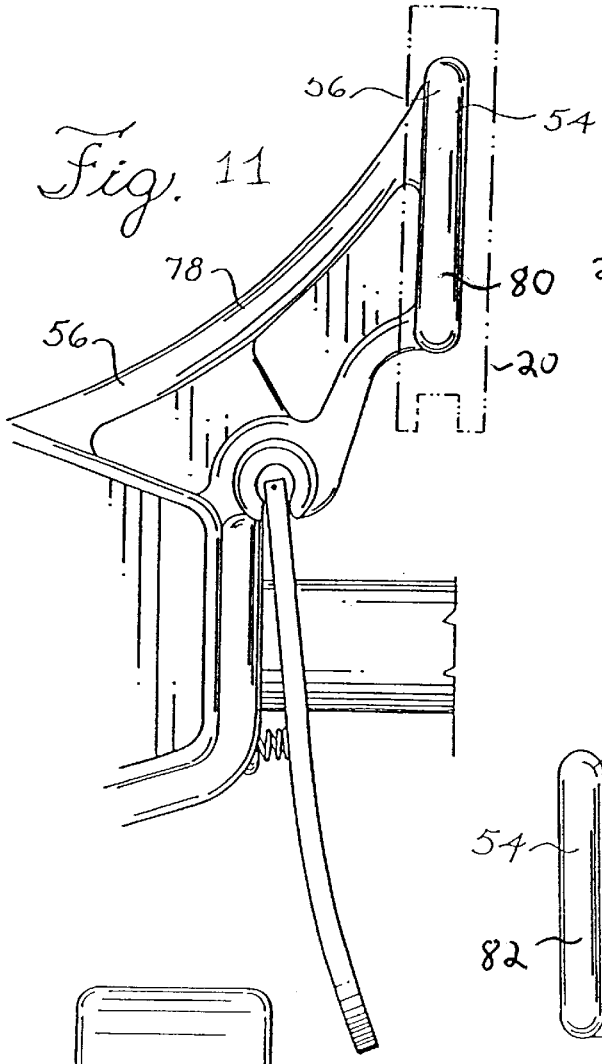
FIG. 11 shows a right side view of the clamping jaw of FIG. 10 with the full face pad of FIGS. 1–9 in phantom.
Figure 10:
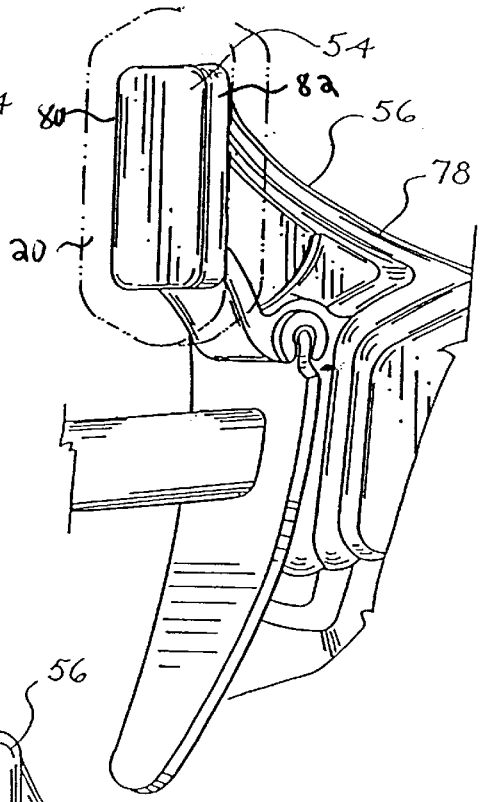
FIG. 10 shows a front perspective view of the fixed clamping jaw of FIG. 1 with the full face pad of FIGS. 1–9 in phantom.
Figure 13:
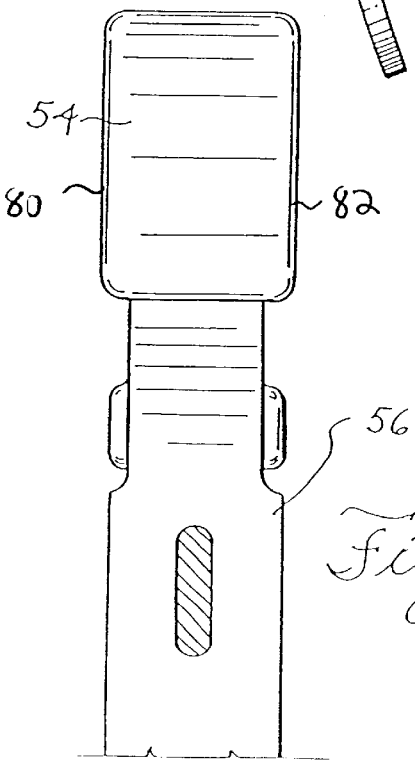
FIG. 13 shows a front view of the clamping jaw of FIG. 10.
Figure 12:
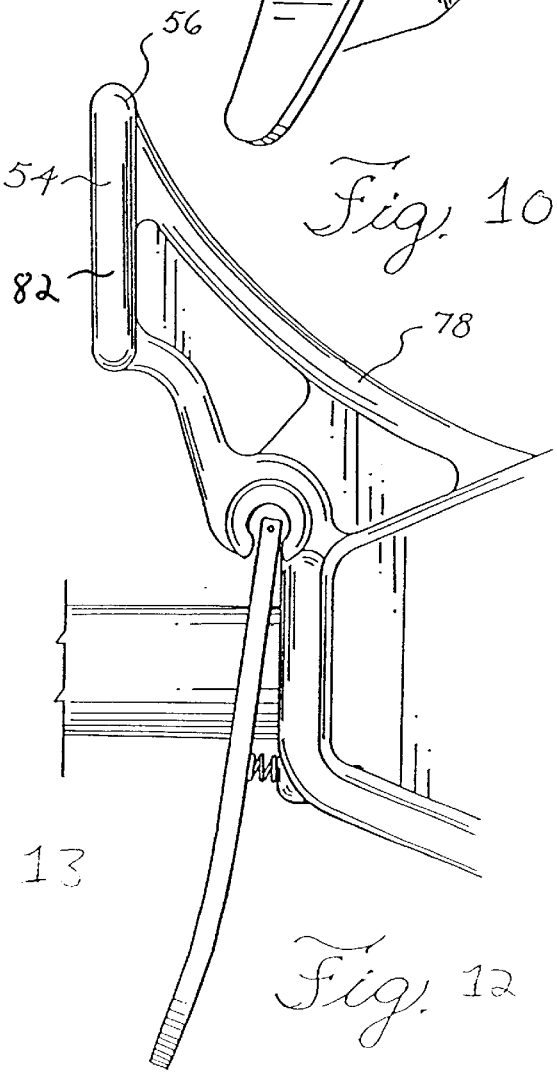
FIG. 12 shows a left side view of the clamping jaw of FIG. 10.
Figure 15:
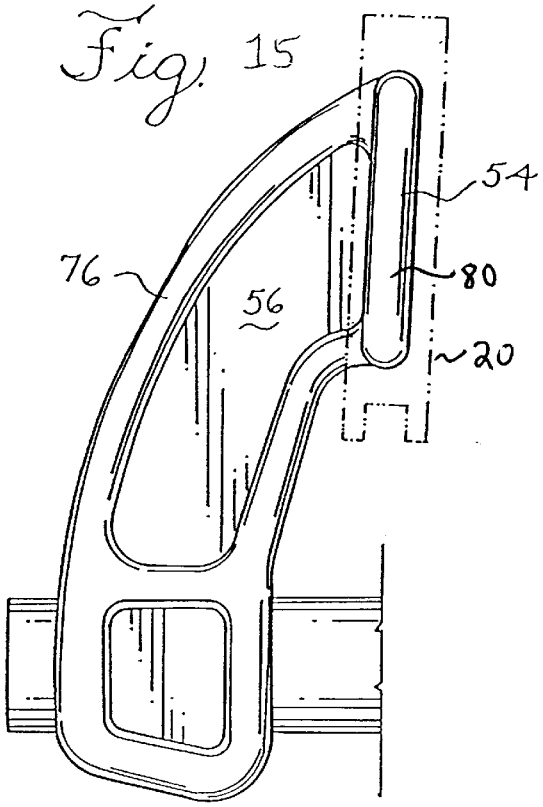
FIG. 15 shows a right side view of the clamping jaw of FIG. 14 with the full face pad of FIGS. 1–9 in phantom.
Figure 14:
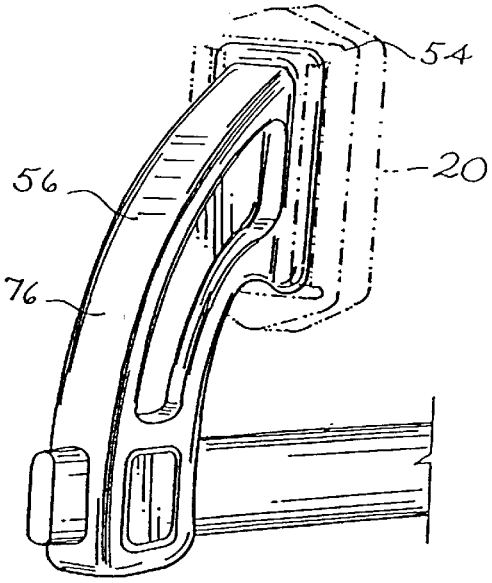
FIG. 14 shows a rear perspective view of the movable clamping jaw of FIG. 1 with the full face pad of FIGS. 1–9 in phantom.
Figure 16:
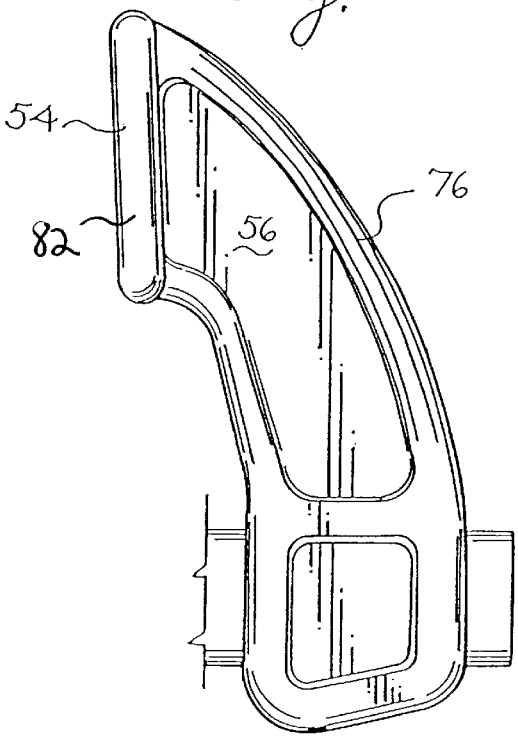
FIG. 16 shows a left side view of the clamping jaw of FIG. 14.
Figure 17:
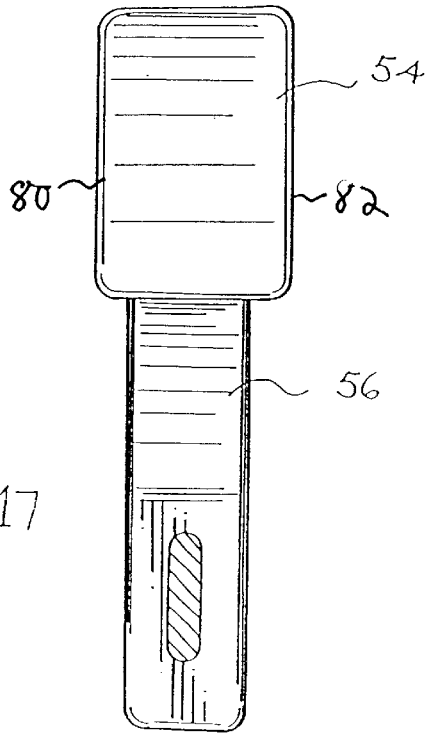
FIG. 17 shows a front view of the clamping jaw of FIG. 14.

As shown in FIGS. 2 and 8, the rear side 38 of the engagement surface 22 is attached to a top wall 40 that extends away from the rear side 38. The top wall has a length of approximately 1 3/8" as measured from inside edge to inside edge and rises above the rear side 38 by approximately 5/16". Side walls 42 and 44, each having a length of approximately 1 11/16" and a height above the rear side 38 of approximately 5/16", are attached to the top wall 40 and the rear side 38, so as to be perpendicular to both the top wall 40 and the rear side 38. The side walls 42 and 44 each extend away from the engagement surface 22 and have one end attached to the top wall 40 and are parallel to one another and separated from one another by approximately 1 3/16".

A bar 46 is attached to the side walls 42 and 44 by having a side ledge portion 43 that is attached to the side wall 42 and a second side ledge portion 45 that is attached to the side wall 44. The side ledge portions 43 and 45 are aligned with each other and extend toward the side wall 44 and the side wall 42, respectively, so that they meet and are integrally attached to one another midway between the side walls 42, 44. The bar 46 has a length of approximately 1 3/8". The bar 46 and the side ledge portions 43 and 45 are spaced above the rear side 38 of the engagement surface 22 such that the bar 46, the side walls 42 and 44 and the engagement surface 22 define a rectangular opening 48. The opening 48 is positioned such that the top wall 40 faces the opening 48. It is understood that the bar 46 may have other shapes without departing from the spirit of the invention. For example, the bar 46 may be shaped to form non-rectangular openings 48. In addition, the rectangular bar 46 may be replaced by having the side ledge portions 43 and 45 being spaced apart from each other by a gap or space (not shown) that is located approximately midway between the side walls.

Figure 9:
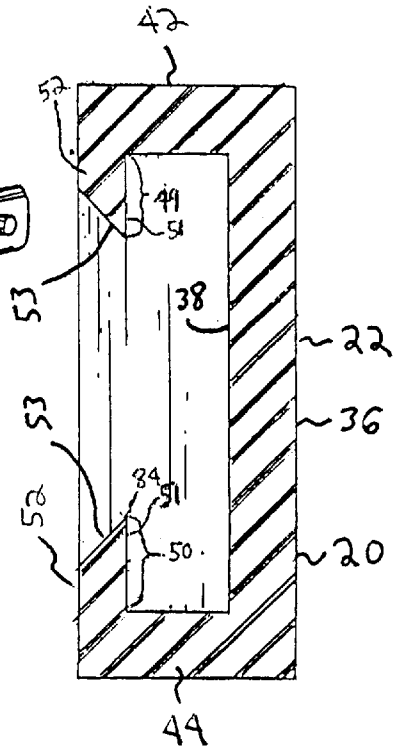
FIG. 9 is a cross-sectional view of the full face pad of FIG. 2 taken along line 9—9 of FIG. 6.
Figure 1:
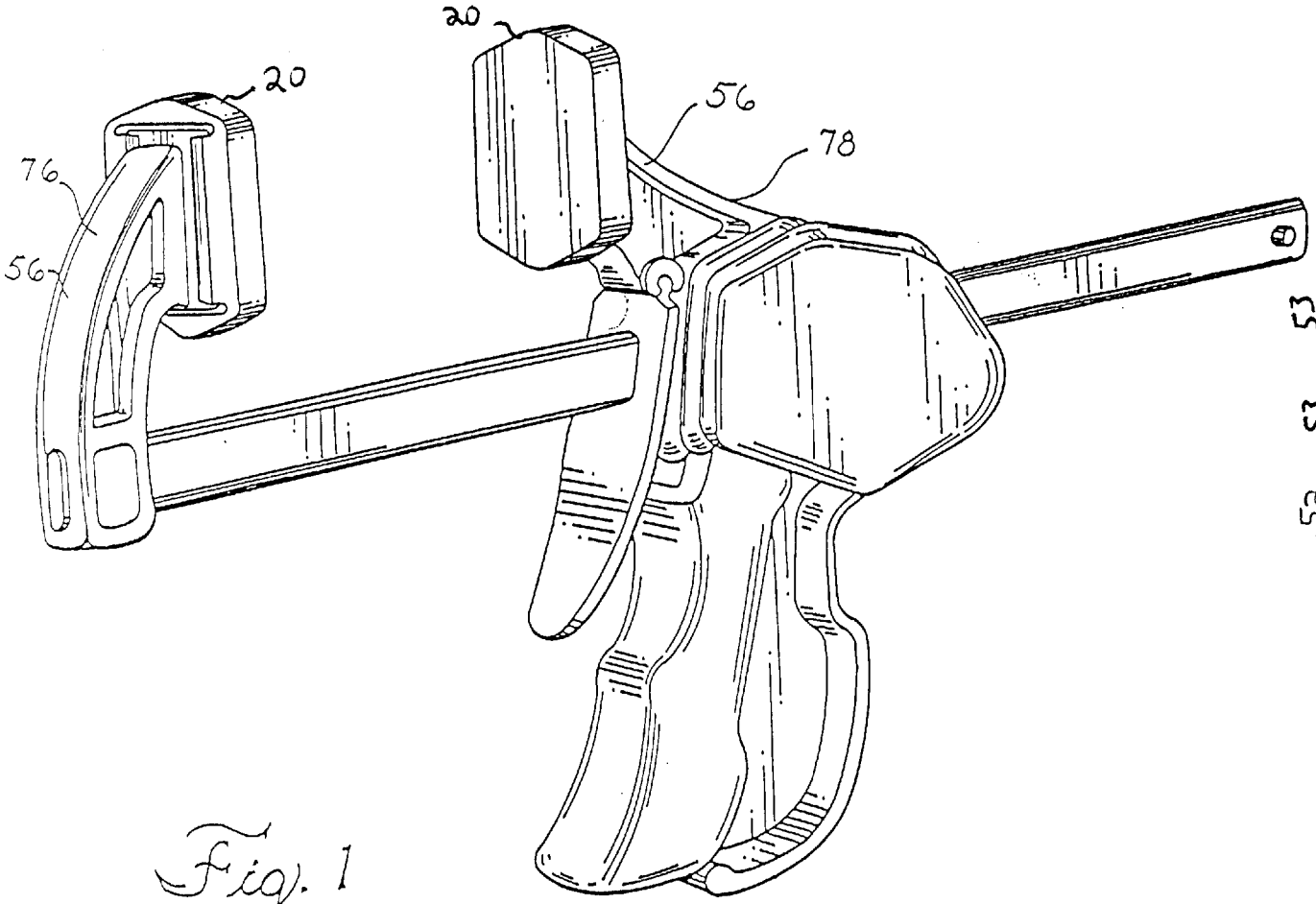
FIG. 1 is a perspective view of a bar clamp that employs a pair of full face pads according to an embodiment of the present invention.
Figure 6:
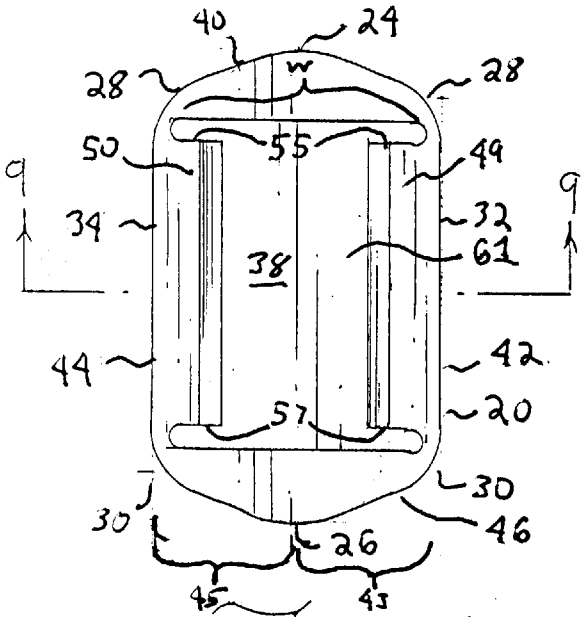
FIG. 6 is a rear view of the full face pad of FIG. 2.

As shown in FIGS. 2, 6 and 9, each side wall 42, 44 has a movable flange 49, 50, respectively, integrally attached thereto so as to extend above the engagement surface 22. Each flange 49, 50 is attached solely to its corresponding side wall 42, 40 and is not attached to the top wall 40. Each flange 49, 50 is identical in shape having a length of approximately 1½" and having a trapezoidal cross-section as shown in FIG. 9. Each flange 49, 50, has a top base 51 and a bottom base 52 that are parallel to one another and the rear side 38. An angled receiving surface 53 is attached to the top base 51 and the bottom base 52. The top base 51 and the bottom base 52 are separated from one another by approximately ⅛". The receiving surface 53 has a width of approximately ⅛" and is angled upward by approximately 45° relative to the bottom base 52. As shown in FIG. 6, the end sides or ends 55 and 57 of the flanges 49, 50 do not contact either the top wall 40 or the bar 46. The ends 55 and 57 are each separated from the top wall 40 and the bar 46 by approximately 1/16".

As shown in FIGS. 2 and 6, the bar 46, the three walls 40, 42 and 44 and the flanges 49, 50 define a receiving element 59 that is attached to the engagement surface 22, wherein the receiving element 59 defines a closed I-shaped opening 61 that faces the rear side 38 of the engagement surface 22. Opening 61 has a length of approximately 1¾" with a maximum width, W, as measured at the top and bottom, of approximately 1⅜" and a minimum width of approximately 13/16". The rear side 38 and the receiving element 59 also define the opening 48 that faces in a direction substantially parallel to the rear side 38 of the engagement surface 22.

The opening 61 is designed to have a rectangular clamping face 54 of a clamping jaw 56 inserted therethrough so that the clamping face 54 abuts the rear side 38 of the engagement surface 22. To improve the attachment of the full face pad 20 to the clamping face 54, a rectangular-like top groove (not shown) is formed in the top wall 40 and faces the opening 48. The flanges 49, 50 and the side walls 42, 44 are attached to one another to form side grooves 60 that face each other. Note that the opening 48 provides an advantage over the scenario where the bar 46 is replaced with a wall that extends to the rear side 38 of the engagement surface 22, in that the opening 48 aids the formation of the top and side grooves during the molding process. Furthermore, the opening 48 can be formed in the top wall 40 or either of the side walls 42, 44 and a bottom wall, like the top wall 40, is formed opposite the top wall.

As shown in FIGS. 10–17, the clamping face 54 to which the full face pad 20 is attached is integrally formed with a jaw 56 that is attached to one end of a curved clamp body 76, 78 that is either fixed (FIGS. 10–13) or movable (FIGS. 14–17). In either case, the full face clamp pad 20 is attached to the clamping face 54 by inserting the clamping face 54 through the opening 61. The flanges 49 and 50 allow the clamping face 54 to be initially placed above the opening 61 so as to be parallel to the rear side 38 of the engagement surface 22. At this point, the clamping face 54 is pushed inward toward the rear side 38 while the clamping face 54 substantially retains its parallel relationship with the rear side 38. As the clamping face 54 is pushed inward, the sides 80 and 82 of the clamping face 54 engage the flanges 49 and 50, respectively. The flanges 49 and 50 are flexible and so bend inward toward the rear side 38 as the sides 80, 82 engage the flanges 49 and 50. Further, inward pushing of the clamping face 54 causes the sides 80, 82 to slide toward the free edges 84 of the receiving surface 53. Further inward pushing of the clamping face 54 causes the sides 80, 82 to pass the free edges 84 and cease contacting the flanges 49 and 50 so as to enter the interior of the clamp pad 20. Once the clamping face 54 ceases to contact the flanges 49 and 50, the flanges 49 and 50 return to their original positions shown in FIGS. 1 and 14. At this point, the sides 80, 82 of the clamping face 54 are contained between and make contact with the rear side 38, the top groove, the flanges 49 and 50 and the bar 46. Note that the bar 46 provides an advantage over a wall that replaces the bar and extends to the rear side 38 of the engagement surface 22, in that the bar 46 would be more flexible than such a wall and, thus, would be easier to deform so as to allow the clamping face 54 to enter the opening 61.

Additional support for the full face pad 20 can be provided by forming the opening 48 in either the top wall 40 or the side walls 42, 44 in the manner described above where a bottom wall is formed opposite the top wall 40. A support (not shown) is integrally attached to the bottom wall so as to extend below the clamping face 54. The support has a shape so that it engages a portion of the clamp body 76, 78. The support gives added support to the lower portion of the full face pad 20 when it is clamping an object. An example of such a support is disclosed in U.S. Pat. No. 5,988,616, the entire contents of which are incorporated herein by reference.

The above described full face pad of FIGS. 1–17 preferably is made of a resilient material, such as a thermal plastic elastomer, and is manufactured by a well known injection molding process. Examples of suitable thermal plastic elastomers are those sold by Monsanto under the trade name Santoprene and those sold by Advance Elastomer under the trade name Vyram.

The foregoing description is provided to illustrate the invention, and is not to be construed as a limitation. Numerous additions, substitutions and other changes can be made to the invention without departing from its scope as set forth in the appended claims. For example, the top wall 40 and the bar 46 can be reversed so that the opening 48 is formed on the side opposite to that shown in FIG. 2.

I claim:

1. A full face clamp pad comprising:

an engagement surface;

a first wall attached to and extending away from said engagement surface;

a second wall attached to and extending away from said engagement surface;

a third wall attached to and extending away from said engagement surface; and a flange attached solely to said first wall and extending above said engagement surface.

2. A full face clamp pad comprising:

an engagement surface;

a first wall attached to and extending away from said engagement surface;

a second wall attached to and extending away from said engagement surface;

a third wall attached to and extending away from said engagement surface; and a flange attached solely to said first wall and extending above said engagement surface, wherein said flange has a trapezoidal cross-section.

3. The full face claim pad of claim 2, wherein said flange comprises:

a first base parallel to said engagement surface;

a second base parallel to said first base; and a receiving surface attached to said first base and said second base and forming an angle with said first base.

4. The full face clamp pad of claim 1, wherein said first wall is separated from and faces said second wall; and a second flange attached solely to said second wall.

5. A full face clamp pad comprising:

an engagement surface;

a first wall attached to and extending away from said engagement surface;

a second wall attached to and extending away from said engagement surface;

a third wall attached to and extending away from said engagement surface;

a flange attached solely to said first wall and extending above said engagement surface; and a bar extending from said first wall to said second wall and spaced from said engagement surface so that said bar, first wall, second wall and engagement surface define an opening.

6. The full face clamp pad of claim 5, wherein said opening is rectangular in shape.

7. The full face clamp pad of claim 4, wherein said third wall is attached to said first wall and said second wall.

8. The full face clamp pad of claim 5, wherein said third wall faces said opening.

9. The full face clamp pad of claim 4, wherein said first wall is parallel to said second wall.

10. The full face clamp pad of claim 7, wherein said first wall is parallel to said second wall; and wherein said third wall is perpendicular to said first wall.

11. A clamping jaw comprising:

a clamp body;

a clamping face attached to one end of said clamp body; and a full face pad attached to said clamping face, wherein said full face pad comprises:

an engagement surface;

a first wall attached to and extending away from said engagement surface;

a second wall attached to and extending away from said engagement surface;

a third wall attached to and extending away from said engagement surface; and a flange attached solely to said first wall and extending above said engagement surface.

12. A clamping jaw comprising:

a clamp body;

a clamping face attached to one end of said clamp body; and a full face pad attached to said clamping face, wherein said full face pad comprises:

an engagement surface;

a first wall attached to and extending away from said engagement surface;

a second wall attached to and extending away from said engagement surface;

a third wall attached to and extending away from said engagement surface; and a flange attached solely to said first wall and extending above said engagement surface, wherein said flange has a trapezoidal cross-section.

13. The clamping jaw of claim 12, wherein said flange comprises:

a first base parallel to said engagement surface;

a second base parallel to said first base; and a receiving surface attached to said first base and said second base and forming an angle with said first base.

14. The clamping jaw of claim 11, wherein said first wall is separated from and faces said second wall; and a second flange attached solely to said second wall.

15. A clamping jaw comprising:

a clamp body;

a clamping face attached to one end of said clamp body; and a full face pad attached to said clamping face, wherein said full face pad comprises:

an engagement surface;

a first wall attached to and extending away from said engagement surface;

a second wall attached to and extending away from said engagement surface;

a third wall attached to and extending away from said engagement surface;

a flange attached solely to said first wall and extending above said engagement surface; and a bar extending from said first wall to said second wall and spaced from said engagement surface so that said bar, first wall, second wall and engagement surface define an opening.

16. The clamping jaw of claim 15, wherein said opening is rectangular in shape.

17. The clamping jaw of claim 14, wherein said third wall is attached to said first wall and said second wall.

18. The clamping jaw of claim 15, wherein said third wall faces said opening.

19. The clamping jaw of claim 14, wherein said first wall is parallel to said second wall.

20. The clamping jaw of claim 17, wherein said first wall is parallel to said second wall; and wherein said third wall is perpendicular to said first wall.

21. A full face clamp pad comprising:

an engagement surface;

a receiving element attached to said engagement surface, wherein said receiving element comprises a movable flange with unattached sides and said receiving element defines a closed opening that faces said engagement surface.

22. The full face clamp pad of claim 21, wherein said flange extends above said engagement surface.

23. A full face clamp pad comprising:

an engagement surface;

a receiving element attached to said engagement surface, wherein said receiving element comprises a movable flange with unattached sides and said receiving element defines a closed opening that faces said engagement surface, wherein said flange has a trapezoidal cross-section.

24. The full face clamp pad of claim 23, wherein said flange comprises:

a first base parallel to said engagement surface;

a second base parallel to said first base; and a receiving surface attached to said first base and said second base and forming an angle with said first base.

25. A full face clamp pad comprising:

an engagement surface;

a receiving element attached to said engagement surface, wherein said receiving element comprises a movable flange with unattached sides and said receiving element defines a closed opening that faces said engagement surface, wherein said engagement surface and said receiving element define a second opening that faces in a direction substantially parallel to said engagement surface.

26. The full face clamp pad of claim 25, wherein said closed opening is I-shaped.

27. The full face clamp pad of claim 25, wherein said second opening is rectangular in shape.

28. The full face clamp pad of claim 26, wherein said second opening is rectangular in shape.

29. A clamping jaw comprising:

a clamp body;

a clamping face attached to one end of said clamp body; and a full face pad attached to said clamping face, wherein said full face pad comprises:

an engagement surface;

a receiving element attached to said engagement surface, wherein said receiving element comprises a movable flange with unattached sides and said receiving element defines a closed opening that faces said engagement surface.

30. The clamping jaw of claim 29, wherein said flange extends above said engagement surface.

31. A clamping jaw comprising:

a clamp body;

a clamping face attached to one end of said clamp body; and a full face pad attached to said clamping face, wherein said full face pad comprises:

an engagement surface;

a receiving element attached to said engagement surface, wherein said receiving element comprises a movable flange with unattached sides and said receiving element defines a closed opening that faces said engagement surface, wherein said flange has a trapezoidal cross-section.

32. The clamping jaw of claim 31, wherein said flange comprises:

a first base parallel to said engagement surface;

a second base parallel to said first base; and a receiving surface attached to said first base and said second base and forming an angle with said first base.

33. A clamping jaw comprising:

a clamp body;

a clamping face attached to one end of said clamp body; and a full face pad attached to said clamping face, wherein said full face pad comprises:

an engagement surface;

a receiving element attached to said engagement surface, wherein said receiving element comprises a movable flange with unattached sides and said receiving element defines a closed opening that faces said engagement surface, wherein said engagement surface and said receiving element define a second opening that faces in a direction substantially parallel to said engagement surface.

34. The clamping jaw of claim 33, wherein said closed opening is I-shaped.

35. The clamping jaw of claim 33, wherein said second opening is rectangular in shape.

36. The clamping jaw of claim 34, wherein said second opening is rectangular in shape.

* * * * *